United States Patent [19]

Duran

[11] Patent Number: 4,478,446

[45] Date of Patent: Oct. 23, 1984

[54] ADJUSTABLE KEEPER ASSEMBLY

[75] Inventor: John A. Duran, Glendora, Calif.

[73] Assignee: Avibank Mfg., Inc., Burbank, Calif.

[21] Appl. No.: 375,878

[22] Filed: Mar. 7, 1982

Related U.S. Application Data

[62] Division of Ser. No. 104,176, Dec. 17, 1979.

[51] Int. Cl.[3] ..... E05B 15/02

[52] U.S. Cl. ..... 292/341.18; 292/113

[58] Field of Search ..... 292/113, DIG. 31, 341.18, 292/158, 139, 341.19, 340, DIG. 31; 254/231, 237, 232, 235

[56] References Cited

U.S. PATENT DOCUMENTS

| | | | |
|---|---|---|---|
| 653,055 | 7/1900 | Baker | 254/232 |
| 705,634 | 7/1902 | Bates | 254/235 |
| 2,904,141 | 9/1959 | Henrichs | 292/341.18 X |
| 3,664,696 | 5/1972 | Poe | 292/66 |
| 4,183,564 | 1/1980 | Poe | 292/113 |

FOREIGN PATENT DOCUMENTS

| | | | |
|---|---|---|---|
| 633301 | 12/1949 | United Kingdom . | |
| 854885 | 11/1960 | United Kingdom | 248/475 B |

*Primary Examiner*—J. Franklin Foss

*Attorney, Agent, or Firm*—Poms, Smith, Lande & Rose

[57] ABSTRACT

An adjustable keeper assembly including a housing and an elongated keeper member disposed therein is disclosed. The keeper member has one end adapted for engaging a latch element and the other end for coupling by way of a coupling member to the housing. The coupling member is disposed within the housing wherein movement of the coupling member is restricted to rotation about its axis. Rotation of the coupling member causes lateral movement of the keeper member relative to the coupling member and housing. This lateral movement of the keeper member provides for taking up of slack between the latch element and keeper member. A plunger is included for releasably locking the coupling member to prevent inadvertent rotation of the coupling member.

8 Claims, 9 Drawing Figures

II
III
IV
12
10
16
18
24
28
56
58
59
60
68
70
72
26
14

13
12
62
64
66
24
26
68
14
50
40
46
48
56
36
28
16
72
18
38
70
42

10
30
68
14
70
66
36
62
18
72
26
16
24
52
12

13
62
26
10
60
24
56
16
48
14
58
28
12

22½
22½

ADJUSTABLE KEEPER ASSEMBLY

This is a division of application Ser. No. 104,176, filed Dec. 17, 1979.

BACKGROUND OF THE INVENTION

The present invention relates generally to the latching of aircraft hatches and doors. Two latches commonly used for this purpose are rotary latches and hook latches. These two latches are especially useful in securing exterior hatches and doors for it is very desirable to have a safe, secure and extremely dependable form of latching.

A common practice is to secure the latch to either the hatch door or the airplane body and to provide a keeper on the opposing surface for engaging the latch. It is critical that a means be provided for adjusting the position of the latch or keeper so that the latch is tightly secured to the keeper. Undesirable rattling and vibrations of exterior hatches may be prevented by adjusting the keeper and latch so that they are tightly secured. This is especially important in high performance aircraft traveling at high speeds.

Generally, adjustment of the keeper and latch is accomplished by providing an adjustable keeper and a stationary secured latch. The present invention relates specifically to providing an improved adjustable keeper which may be used for engaging both rotary and hook latches.

It is desirable that the keeper be adjustable when latched to a rotary or hook latch and that external access be provided for accomplishing such adjustment. The adjustable keeper should be safe, dependable and simple in operation. It is also desirable that the range of adjustment not be limited and that means be provided for locking the keeper to prevent inadvertent adjustments.

U.S. Pat. No. 4,158,463 issued to Henriches on June 19, 1979 discloses and adjustable keeper of the type to which this invention is directed. The Henrichs patent discloses an adjustable keeper which utilizes a screw element extending transverse to the direction of movement of the keeper which is used to transversely move a drive block having a beveled cam end. Transverse movement of the beveled cam end results in adjustable movement of the keeper. This particular adjustable keeper is for use with rotary latches only. Although it does provide for external adjustment of the keeper while engaged to a rotary latch, the range of adjustment is limited and means are not provided for locking the screw element to prevent unwanted adjustment of the keeper.

It is therefore an object of the present invention to disclose and provide an adjustable keeper which is provided with external access for adjusting the keeper when the keeper is latched to a latch element.

Another object of the present invention is to provide an adjustable keeper which may be utilized for engaging both rotary latches and hook latches.

An additional object of the present invention is to provide an adjustable keeper having a relatively wide range of adjustment.

A further object of the present invention is to disclose and provide an adjustable keeper which is provided with means for locking the adjustment of the keeper to prevent inadvertent and unwanted adjustment of the keeper.

A final object of the present invention is to disclose and provide an adjustable keeper which is simple and dependable for its intended use.

SUMMARY OF THE INVENTION

The present invention is an adjustable keeper which is adapted for mounting on a support structure such as an aircraft body or hatch. The adjustable keeper is adapted to engage a latch element associated with a rotary or hook latch mounted on an opposing hatch or aircraft body surface.

The adjustable keeper includes a housing having mounting means for securing the housing to the support structure. A movable keeper member is disposed in the housing. The movable keeper member includes an engaging portion for engagement to the rotary or hook latch element. Means are provided for movably adjusting the keeper member to provide secure engagement between the keeper member engaging portion and the latch element. Additionally, locking means are provided for releasably locking the adjustment means to prevent inadvertent and unwanted movable adjustment of the keeper member.

A more complete understanding of the adjustable keeper assembly in accordance with the present invention, as well as a recognition of additional objects and advantages therefor, will be afforded to those skilled in the art from a consideration of the following detailed description of exemplary embodiments thereof. Reference will be made to the appended sheets of drawings which will first be discussed briefly.

DETAILED DESCRIPTION OF PREFERRED EXEMPLARY EMBODIMENTS

Figure 1:
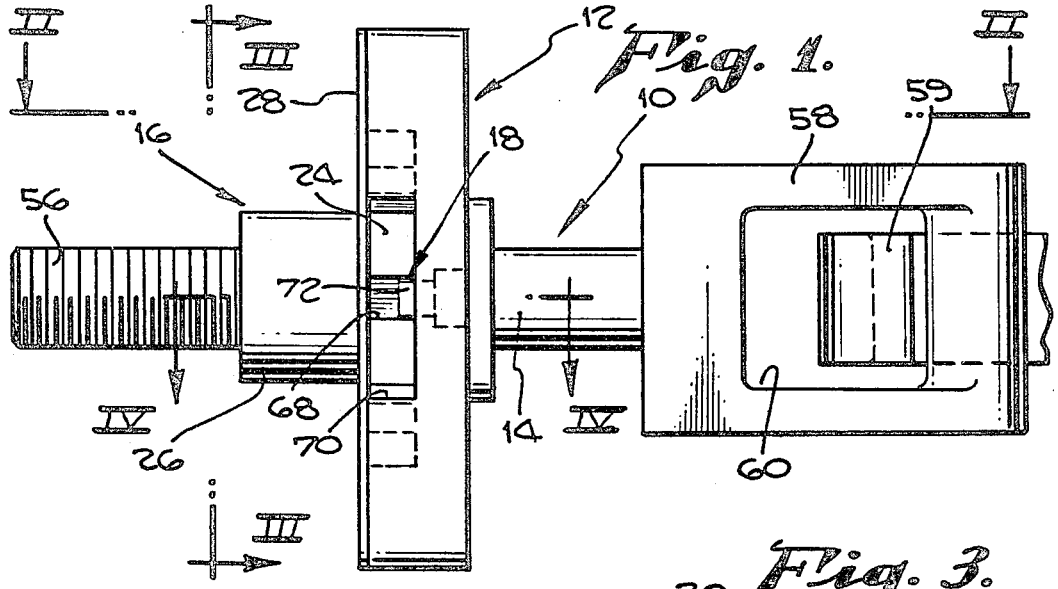
FIG. 1 is a side view of the preferred adjustable keeper assembly of the present invention.

The preferred exemplary embodiment of the adjustable keeper assembly of the present invention is shown generally at 10 in FIG. 1. The preferred adjustable keeper assembly is composed of four major components. These components are shown in FIG. 1 as the housing assembly shown generally at 12; keeper member 14; the coupling member shown generally at 16 (partially shown in phantom); and the plunger shown generally at 18 (also shown partially in phantom).

Figures 5, 6, 7:
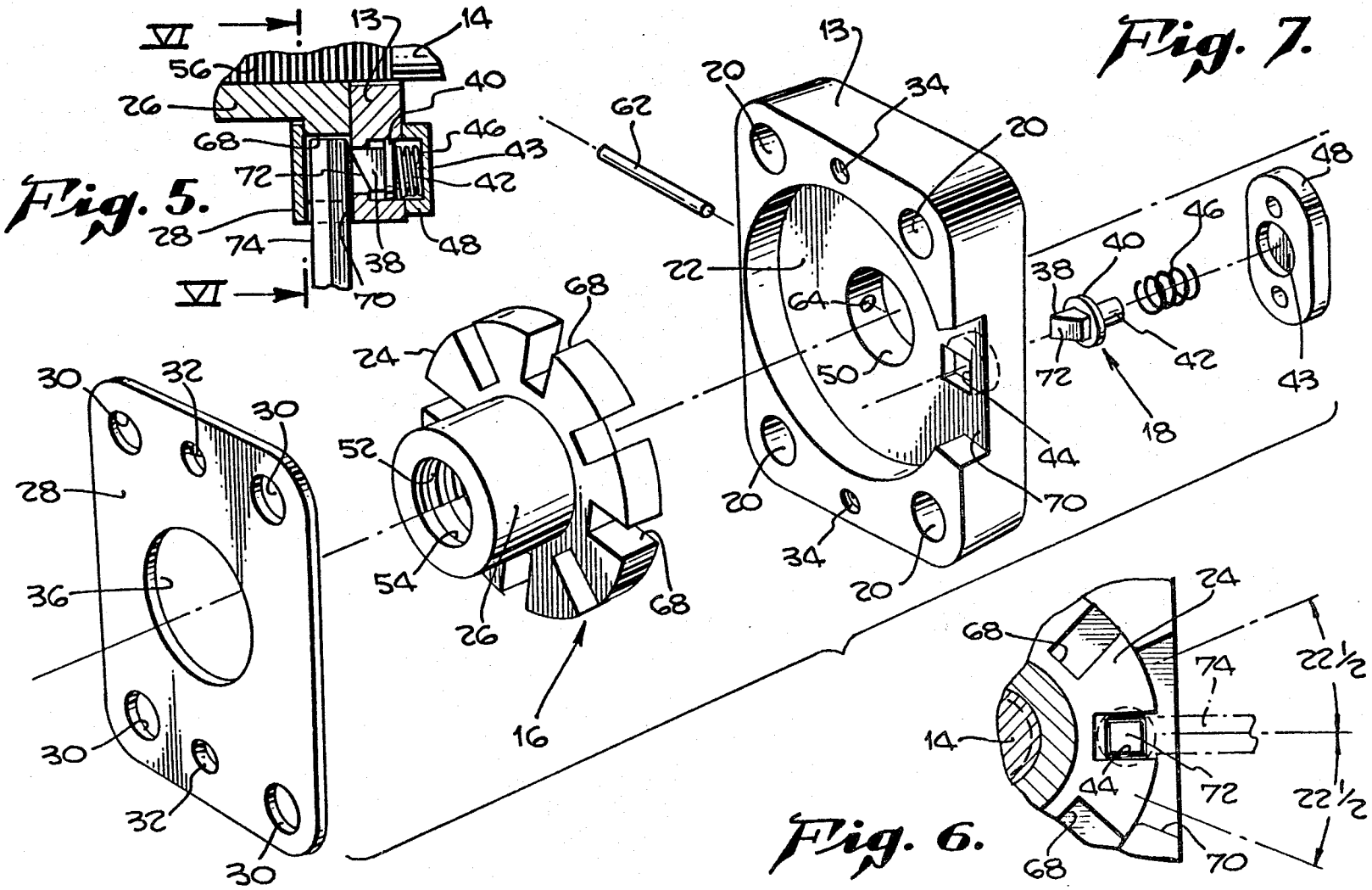
FIG. 5 is a detailed view of FIG. 4 showing the plunger 38 in a coupling member release position.
FIG. 6 is a cross-sectional view of FIG. 5 taken in the VI—VI plane.
FIG. 7 is an exploded view of the preferred adjustable keeper assembly of the present invention. This view does not show the elongated keeper member (14).

The components are best shown in FIG. 7. The keeper member 14 is not shown in FIG. 7, however, it can be seen from FIG. 1 that the keeper member 14 will be inserted along the center line of FIG. 7. Referring again to FIG. 7, mounting means for securing the housing assembly 12 to a desired support structure are provided by holes 20 in housing 13 and by holes 30 in housing plate 28. The housing 13 and housing plate 28 when viewed together are the housing assembly 12. The holes 20 and 30 are conveniently placed at the four corners of the housing 13 and housing plate 28 so that four bolts, screws, rivets or the like may be utilized to securely mount the entire housing assembly 12 to the desired support structure. The support structure may be either the aircraft body or conversely the hatch or doorway of the aircraft.

The housing 13 has a centrally located cylindrical chamber 22 which is shaped to receive the coupling member 16. The coupling member 16 includes an irregular cam portion 24 which is an integral part of bushing 26. Preferably, the coupling member 16 including its two elements, bushing 26 and irregular cam portion 24, are machined from the same piece of metal stock. The irregular cam portion 24 is shaped so that it fits within the cylindrical housing chamber 22.

Housing plate 28 as part of the housing assembly 12 is included for restricting lateral movement of the coupling member 16. As previously mentioned, the housing plate 28 is provided with holes 30 for mounting purposes. The housing plate holes 30 are positioned on the housing plate 28 so that they align with mounting holes 20 on the housing 13. This arrangement of housing holes 20 and housing plate holes 30 allows for the passage of mounting bolts or screws entirely through the housing assembly 12. Attachment holes 32 are provided on the housing plate 28 for allowing attachment of the housing plate 28 flush with the housing 12. The housing 12 is provided with attachment holes 34 which are aligned with housing plate attachment holes 32 to allow secure attachment by bolts, screws or the like. The housing plate 28 has a centrally located bushing hole 36. The housing plate bushing hole 36 has a sufficient diameter to allow insertion of bushing portion 26 of the coupling member 16 therethrough. When the housing plate 28 is attached flush with housing 13, the irregular cam portion 24 of coupling member 16 is sandwiched within cylindrical housing chamber 22. Lateral movement of the coupling member 16 is thereby restricted, however, the coupling member 16 is free to rotate about its axis.

The final major component shown in FIG. 7 is the plunger 18. The plunger 18 has a square front portion 38, a ridge portion 40 and a body portion 42. Square orifice 44 is provided in housing 13 to allow insertion of the plunger square front portion 38 into cylindrical housing chamber 22. The ridge portion 40 on the plunger 18 provides a positive stopping surface to prevent the plunger 18 from moving too far into the cylindrical housing chamber 22. Spring 46 fits concentrically over body portion 42 and is used to bias the plunger 18 toward cylindrical housing chamber 22. A backing plate 48 is provided for securing the plunger 18 and its spring bias 46 within housing 13, body portion 42 entering aperture 43 in plate 48.

In assembling the components of FIG. 7, the housing plate 28, by way of bolts or the like inserted and secured within holes 32 and 34, is secured to housing 13 with coupling member 16 being sandwiched therebetween. The keeper member 14 (not shown in FIG. 7) is inserted through orifice 50 in housing 13 and thereby into orifice 52 in coupling member 16.

Orifice 52 of coupling member 16 has threads 54. The coupling member threads 54 are designed to mate with threads 56 on the keeper member 14. It can be seen that rotation of coupling member 16 results in lateral movement of keeper member 14 due to the thread coupling relationship between coupling threads 54 and keeper member threads 56. Thus having briefly described the major components and assembly configuration of the preferred embodiment of the present invention, a more detailed description of the preferred adjustable keeper 10 assembly and its operation will now be given.

Latch engaging means, as particularly contemplated by this invention, for releasable engagement to a latch element is provided by keeper member latch ring 58 (FIG. 1). The latch ring 58 defines an opening 60 through which a hook latch element such a hook latch element 59 or a rotary latch element (not shown) may be inserted for releasable engagement.

The movable keeper member 14 includes mounting means at one end for coupling the keeper member 14 to a support structure by way of housing assembly 12. Mounting means as particularly contemplated by this invention include threads 56 on the keeper member 14. The threads 56 provide mounting means in that threads 56 mate with threads 54 of coupling member 16 which is mounted within housing assembly 12. Housing assembly 12, in turn, is securely mounted to the desired support structure. The keeper member 14 is thereby indirectly coupled to the support structure.

Adjustment means are provided for laterally moving or drawing up the keeper member 14 with respect to both the housing assembly 12 (which is secured to a support structure) and the desired rotary or hook latch element thereby taking up slack therebetween. As particularly contemplated by the present invention, the adjustment means includes coupling member 16 and movement means for causing lateral movement of the keeper member 14 relative the coupling member 16. The movement means are provided by threads 54 located along the surface defining coupling member orifice 52. Threads 54 mate with threads 56 on the keeper member 14 so that rotatable movement of the coupling member 16 about the longitudinal axis of the keeper member 14 results in lateral movement of the keeper member 14.

Figure 4:
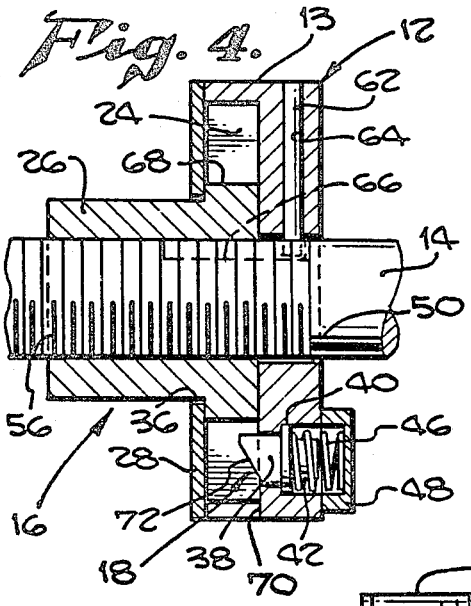
FIG. 4 is a cross-sectional view of FIG. 1 taken in the IV—IV plane. This view shows the plunger 38 in the coupling member engaged position.
Figure 3:
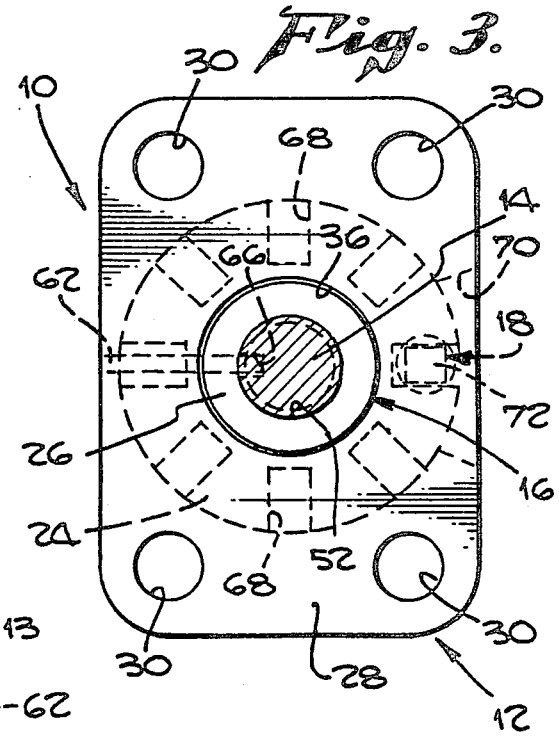
FIG. 3 is a view of FIG. 1 taken in the III—III plane.

Keeper restricting means are also provided for preventing rotation of the keeper member 14 about its longitudinal axis. In the preferred embodiment, the keeper restricting means includes a pin 62 as shown in FIG. 4 which is associated with the housing by way of keeper pin mounting orifice 64 in housing 13 (See also FIG. 7). The pin 62 fits relatively tightly within the keeper pin mounting orifice 64 and extends transversely into groove 66 in the keeper member 14. The groove 66 is shown in phantom in FIG. 4. The pin 62, as inserted in groove 66, prevents the keeper member 14 from rotating when coupling member 16 is rotated. The length of groove 66 determines the bounds of lateral movement for the keeper member 14. This groove can be of any desired length and, if desirable, could be extended the entire length of the keeper member 14 thereby providing a wide degree of lateral adjustment.

To effect lateral movement of the keeper member 14, there must be some means for rotating the coupling member 16. Such rotation means preferred in the present invention include slots 68 in irregular cam portion 24. It is not necessary that slots 68 extend entirely through the irregular cam portion 24, however, it is preferred. By inserting any conveniently sized tool within slots 68, rotation of coupling member 16 may be accomplished. Virtually any type of conveniently sized tool may be used for insertion into slots 68. The preferred tool for use in insertion into the slots 68 is a suitably sized Allen wrench shown as 74 in FIG. 5. An Allen wrench is preferred since it is a tool commonly found in most mechanic's tool boxes and is structurally well suited for use with the preferred embodiment of the present invention.

An opening 70 is provided in housing 13 (as best shown in FIG. 7) for allowing external access to slots 68. As shown in FIG. 6, when a slot 68 is centrally located within housing opening 70, the coupling member 16 may be rotated approximately 22½ degrees in either direction by the Allen wrench 74 (shown in phantom). The slots 68 are positioned on the irregular cam member 24 so that at least one slot 68 is always accessible through housing opening 70. Once the coupling member 16 has been rotated to the desired position of lateral adjustment of keeper member 14, it is important that a means be provided for locking the coupling member 16 to prevent rotation of the coupling member 16 thereby preventing lateral movement of the keeper member 14 out of adjustment.

Such locking means as specifically contemplated by the preferred embodiment of the present invention includes pawl means such as plunger 18 slidably associated with the housing 13 and movable between a coupling member engaged position as shown in FIG. 4 and a coupling member release position as shown in FIG. 5. The plunger 18 is normally biased by spring 46 to the coupling member engaged position. The plunger square fron portion 38 is shaped to fit snugly within any one of the slots 68. Whenever a slot 68 is disposed directly over housing square orifice 44, the square front portion 38 is forced by spring bias 46 into the slot 68 thereby preventing rotation of coupling member 16. The slots 68 act as pawl engagement means or plunger engagement means for the coupling member 16.

Once the plunger square front portion 38 has been inserted into a slot 68, the coupling member 16 cannot be rotated. To provide releasable locking thereby allowing subsequent rotation of the coupling member 16, the plunger front portion 38 has a sloping surface 72 which slopes toward the coupling member 16. When the Allen wrench 74 or other suitable key is inserted into one of the slots 68, when the slot is engaged with the plunger square front portion 38, the key contacts the sloping surface 72 slidably camming the plunger 18 to its coupling member release position. If the Allen wrench 74 is removed from slot 68 when slot 68 is aligned with square orifice 44, plunger 18 is biased into its coupling member engaged position thereby restricting rotation of the coupling member 16. If the Allen wrench 74 is removed from a slot 68 when the slot 68 is not aligned with square orifice 44, the coupling member 16 will only rotate to a position where the next available slot 68 aligns with square orifice 44. As the next available slot 68 aligns with square orifice 44, plunger 18 is again spring biased into its coupling member 16 engaged position thereby locking said coupling member 16.

Figure 2:
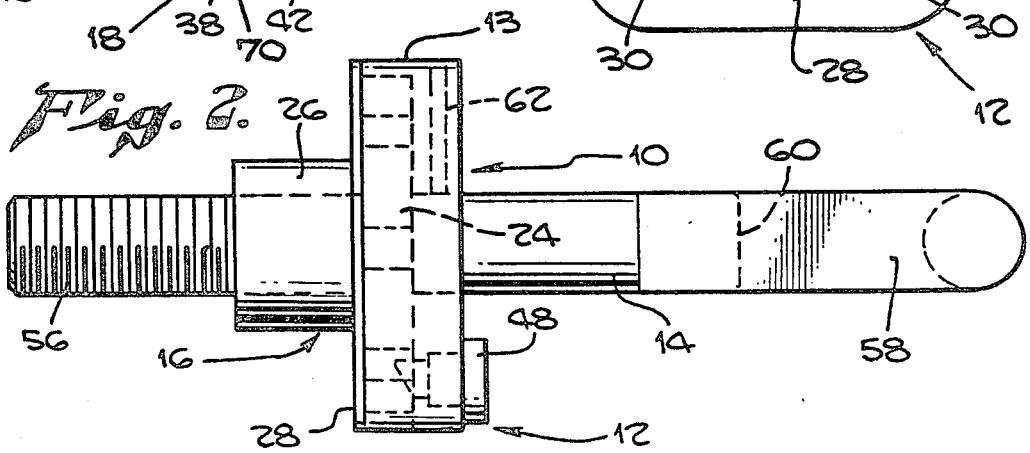
FIG. 2 is a view of FIG. 1 taken in the II—II plane of FIG. 1.

The adjustable keeper of the present invention as shown in FIG. 1 depicts the keeper member latch ring 58 in the usual configuration adapted for latching to a hook latch element 59. To adapt the keeper member latch ring 58 to a position for latching to a conventional rotary latch, it is only necessary that either the groove 66 in the keeper member 14 or the pin 62 in the housing be moved 90 degrees along the keeper member's 14 axis of rotation. This would result in keeper member latch ring 58 being rotated 90 degrees about the keeper member 14 longitudinal axis from its position depicted in FIGS. 1 and 2 and into position for latching to a rotary latch.

The above-described preferred adjustable keeper assembly discloses locking means which are positive in nature. In other words, once the plunger 18 has been inserted into a slot 68 in coupling member 16 (as shown in FIG. 4), the coupling member 16 cannot be rotated until the plunger 18 has been actuated out of slot 68 into its retracted position (as shown in FIG. 5).

In many circumstances, it may be desirable to provide a locking means which is not positive in nature, but would still have sufficient locking characteristics to prevent inadvertent rotation of coupling member 16. For example, plunger 18 may be replaced by a ball detent or pawl means of suitable size such as a metal ball bearing. The detent ball would not have the positive lock characteristics of plunger 18; however, the spring loaded detent ball would provide sufficient locking when partially inserted in a slot 68 to prevent inadvertent rotation of coupling member 16.

Figure 9:
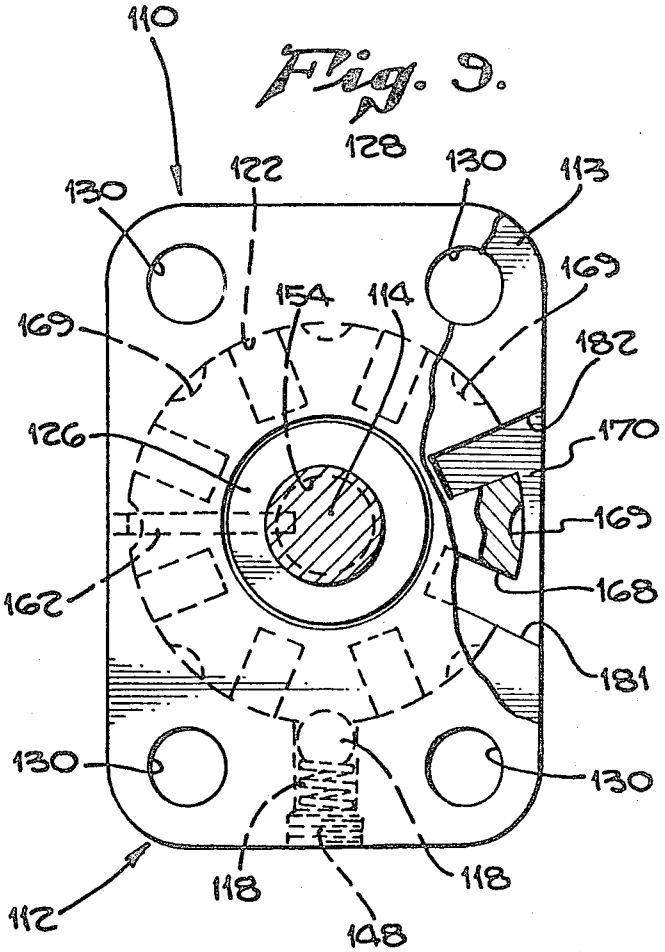
FIG. 9 is a view of FIG. 8 taken in the IX—IX plane.
Figure 8:
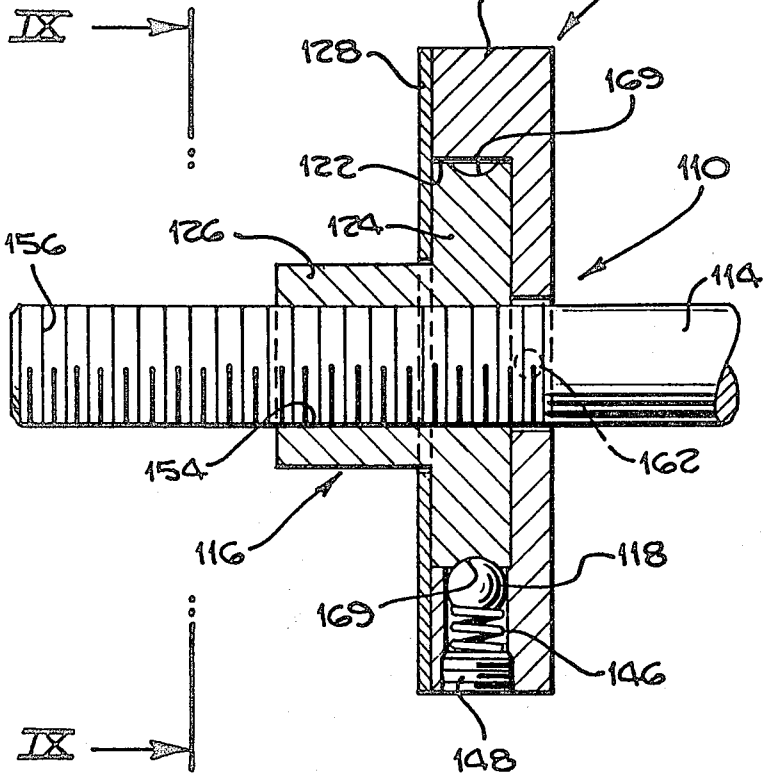
FIG. 8 is a side view of a second preferred adjustable keeper assembly of the present invention.

A second preferred embodiment of the present invention is shown in FIGS. 8 and 9. This second embodiment is basically the same as the above-described preferred embodiment except that a different, nonpositive, locking means is provided. The second preferred exemplary embodiment is shown generally at 110. It also has a housing assembly shown generally at 112 which is composed of a housing 113 and a housing plate 128. Keeper member 114 is also supplied with keeper member threads 156 which engage coupling threads 154 located within bushing 126. Pin 162 is similarly provided for preventing rotation of keeper member 114. Mounting holes 130 are also provided.

In the second alternative embodiment, the coupling member shown generally at 116 is the same as coupling member 16 of the first preferred embodiment of the adjustable keeper assembly except that it is provided with engagement means, such as mating dimples 169. The mating dimples 169 are located around the exterior edge of the irregular cam portion 124.

Pawl means for this second preferred embodiment are provided by the ball detent 118. The ball detent 118 is spring biased into engagement with mating dimples 169 by spring 146. The spring 146 and detent ball 118 are held in place by plug 148.

As best shown in FIG. 9, it can be seen that as coupling member 116 is rotated, the ball detent 118 will be spring biased into mating dimples 169 to provide nonpositive locking of the coupling member 116. To overcome the locking action of detent ball 118 when it is engaged with either a mating dimple 169, it is only necessary to exert a sufficient amount of rotation force on coupling member 116 to overcome the friction of the ball detent 118 as biased by spring 146. Although the ball detent 118 locking means as just described is not positive, it may be adequate for some applications where positive locking is not absolutely necessary.

The slots 168 in irregular cam portion 124 are of a width which is less than the diameter of ball detent 118. As the ball detent 118 passes over a slot 168, it is desirable that very little, if any, locking action occurs. It is preferred that the slot 168 be of a sufficient width to allow insertion of a standard Allen wrench, (such as a 5/16 inch Allen wrench) while still having a width which does not permit locking of the ball detent 118 within the slot 168. This is important in applications where it is desirable that slots 168 be moved a full stroke (from one end of the housing opening 181 to the other end of the housing opening 182) within housing opening 170 before any locking action occurs. For example, at the beginning of each stroke, the ball detent 118 is mated with a dimple 169. During the stroke, the ball detent 118 passes over slot 168 which has a sufficiently small width that no appreciable locking action takes place. At the end of the stroke, the ball detent 118 is reinserted into mating engagement with the next dimple 169.

Having thus described the exemplary embodiments of the present invention, it should be noted by those skilled in the art that the within disclosures are exemplary only and the various other alternatives, adaptations and modifications may be made within the scope of the present invention. Accordingly, the present invention is not limited to the specific embodiments as illustrated herein and is defined only by the following claims.

What is claimed is:

1. An adjustable keeper assembly adapted for mounting on a support structure and engaging a latch element, said assembly being engagable by an external tool for adjusting the same, said keeper assembly comprising:

a housing having an opening therein adapted to receive said tool therein;

mounting means for securing said housing to said support structure;

a movable keeper member disposed in said housing and having mounting means at one end for coupling said member to a support structure and latch engaging means at the other end for releasable engagement to a latch element;

adjustment means comprising a rotatable wheel having a plurality of spaced radially extending slots therein for drawing up said keeper member with respect to both said support structure and said latch element thereby taking up slack therebetween, rotation of said wheel orienting selective ones of said slots in said wheel with said opening in said housing thereby allowing a tool to be inserted into said opening in said housing and into engagement with selective ones of said slots in said wheel to thereby rotate the same; and locking means movable between a wheel engaging and a wheel disengaging position entering said opening in said housing and into a position engaging said selective ones of said slots and adapted to be engaged by a tool entering said opening in said housing to thereby disengage said locking means to permit rotation of said wheel and lock said wheel after rotation thereof upon withdrawal of a tool from said opening in said housing thereby preventing movable adjustment of said keeper member after the taking up of slack between said latch element and said support structure.

2. The adjustable keeper assembly of claim 1 wherein said lateral movement of said wheel is restricted, said wheel including a centrally located orifice through which said keeper member is disposed substantially normal to said wheel;

movement means for causing lateral movement of said keeper member relative to said wheel by rotatable movement of said wheel about the longitudinal axis of said keeper member; and keeper restricting means associated with said housing and said keeper member for restricting rotation of said keeper member about the longitudinal axis of said keeper member.

3. The adjustable keeper assembly of claim 2 wherein said movement means includes a threaded portion on said keeper member which mates with threads located on the surface of said wheel which defines said wheel orifice, whereby rotation of said wheel causes lateral movement of said keeper member.

4. The adjustable keeper assembly of said claim 2 wherein said locking means includes pawl means slidably associated with said housing and movable between a wheel engaged position and a wheel release position, said pawl means being normally biased to said wheel engaged position.

5. The adjustable keeper assembly of claim 6 including a tool in the form of a key and wherein said pawl means includes a plunger with a front portion having an end which slopes toward said wheel wherein insertion of said key into one of said slots, when said slot is engaged with said pawl, causes slidable contact of said key with said pawl sloping end whereby said pawl is moved to its wheel release position.

6. The adjustable keeper assembly of claim 5 wherein said key is an elongated rod having a hexagonal cross section.

7. An adjustable keeper device comprising:

a housing;

an elongated keeper member disposed within said housing having one end adapted for engaging a latch element and the other end threaded for coupling to said housing, wherein rotatable movement of said elongated member about its axis is restricted by a pin member associated with said housing and extending transversely into said keeper member;

a coupling member disposed within said housing wherein movement of said coupling member is restricted to rotation about its axis, said coupling member having a centrally located threaded surface defining an orifice for coupling to said threaded end of said keeper member, whereby rotation of said coupling member causes lateral movement of said keeper member relative said coupling member and said housing, said coupling member including slots extending radially outward, a key for inserting into one of said slots to provide manual rotation of said coupling member, and an opening in said housing to allow access externally of said housing to said coupling member slots, a plunger associated with said housing and insertable within said slots, said plunger being movable between a slot engaged position and a slot release position; and a spring for normally biasing said plunger to its slot engaged position whereby insertion of said plunger into one of said slots prevents rotation of said coupling member about its axis.

8. The adjustable keeper device of claim 7 wherein said plunger includes a front portion having an end which slopes inwardly toward said coupling member whereby inward insertion of said key into a coupling member slot having said plunger disposed therein, said plunger being in its slot engaged position, causes transverse movement of said plunger against its spring bias to its slot disengaged position.

* * * * *